US005320417A

United States Patent [19]

Trosky

[11] Patent Number: 5,320,417

[45] Date of Patent: Jun. 14, 1994

[54] ROLLER SKATING WHEEL

[75] Inventor: Robert Trosky, Tampa, Fla.

[73] Assignee: Creative Urethanes, Purcellville, Va.

[21] Appl. No.: 15,154

[22] Filed: Feb. 11, 1993

[51] Int. Cl.[5] ..... B60B 9/00

[52] U.S. Cl. ..... 301/5.3; 301/6.2; 280/11.19; 244/103 S

[58] Field of Search ..... 301/5.3, 5.7, 6.2; 280/11.19, 11.22, 11.23; 244/103 R, 103 S

[56] References Cited

U.S. PATENT DOCUMENTS

| | | | |
|---|---|---|---|
| 1,394,589 | 10/1921 | Swinehart | 152/326 |
| 1,591,982 | 7/1926 | Kirkwood | 152/326 |
| 1,662,007 | 3/1928 | Kuhlke | 152/326 X |
| 1,702,081 | 2/1929 | Hatfield | 152/326 X |
| 3,992,025 | 11/1976 | Amelio | 301/5.7 X |

FOREIGN PATENT DOCUMENTS

| | | | |
|---|---|---|---|
| 324772 | 11/1918 | Fed. Rep. of Germany | 244/103 S |

*Primary Examiner*—Russell D. Stormer

*Attorney, Agent, or Firm*—Stevens, Davis, Miller & Mosher

[57] ABSTRACT

A wheel of a roller skate includes a plurality of circumferentially spaced apart generally axially extending curvilinear paths. A speed skater, traveling a predominately circular course with such wheels properly aligned on such skates, is able to use air moving past the skater to increase skating speed. As air enters the curvilinear paths of the wheel the direction of air flow changes. In this manner, momentum is transferred from the moving air to the spinning wheels, thus increasing the number of revolutions of the wheel and the speed of the skater.

12 Claims, 5 Drawing Sheets

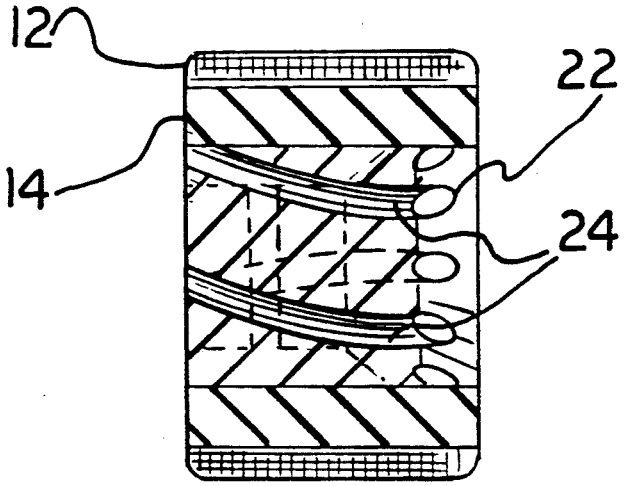
FIG. 3
FIG. 6
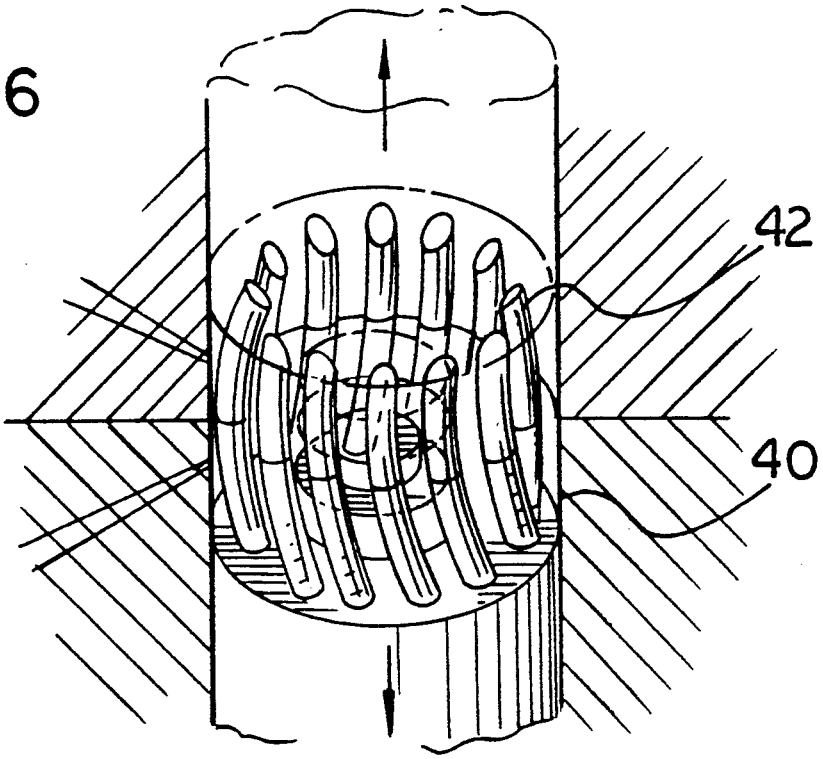

ROLLER SKATING WHEEL

FIELD OF THE INVENTION

The invention relates to improvements to the wheel of a speed roller skate, and more specifically to the hub of the wheel.

BACKGROUND OF THE INVENTION

In the world of roller speed skating, as in many activities today, it is believed that athletes are reaching thresholds of performance which cannot be surpassed by relying solely on the human factor. There is just simply a limit to what the human body, by itself, can achieve. Currently, speed skaters are reaching maximum speeds, around a predominately circular course, of thirty miles per hour.

In view of such limits, more and more athletes seek improvements in the equipment they use to best their competition and achieve record setting results. One way to attempt to improving such equipment is to make the equipment lighter. For instance, it is known to drill a plurality of paths having a circular cross section through the hub of a roller skating wheel, parallel to the axis of rotation of the wheel. Such drilling lightens the hub and is ornamentally attractive. However, any improvement achieved in increased speeds is practically unmeasurable.

The present invention is an improvement to the hub of the wheel of a roller skate that produces measurable improvements in speed skating performance.

SUMMARY OF THE INVENTION

The improvement to the wheel of a roller skate includes a plurality of spaced apart and circumferentially arranged curvilinear paths extending generally axially through the hub. A speed skater, traveling a predominately circular course with such wheels properly aligned on roller skates, is able to use air moving past the skater to increase skating speed. As air enters the curvilinear paths of the wheel the direction of air flow changes. In this manner, momentum is transferred from the moving air to the spinning wheels, thus increasing the speed and number of revolutions of the wheel.

BRIEF DESCRIPTION OF SEVERAL VIEWS OF THE DRAWINGS

FIG. 3 side view in sectional view of the wheel of FIG. 2*a;*

FIG. 6 is a perspective of a mold similar to the mold used to create the wheel of the invention.

DETAILED DESCRIPTION OF THE INVENTION

Figure 1A:
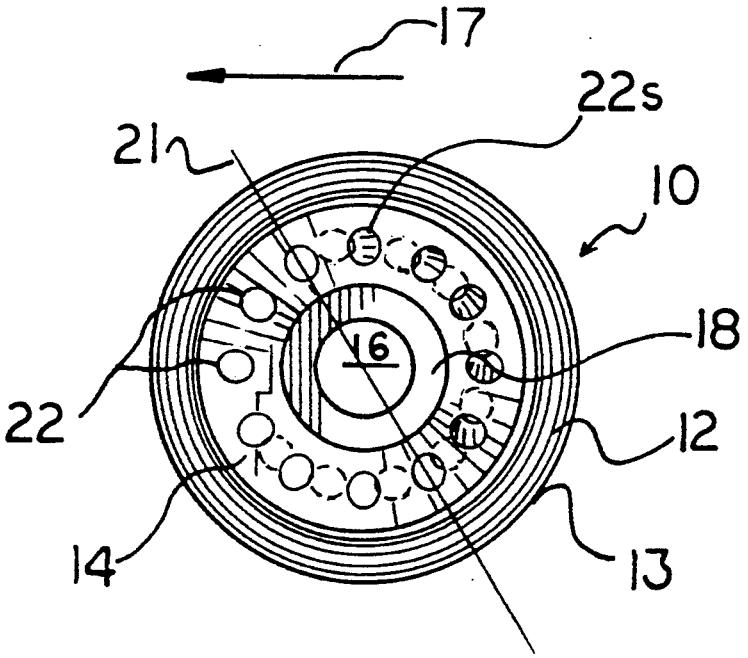
FIG. 1*a* is a front view of a left-handed wheel of the present invention.
Figure 1B:
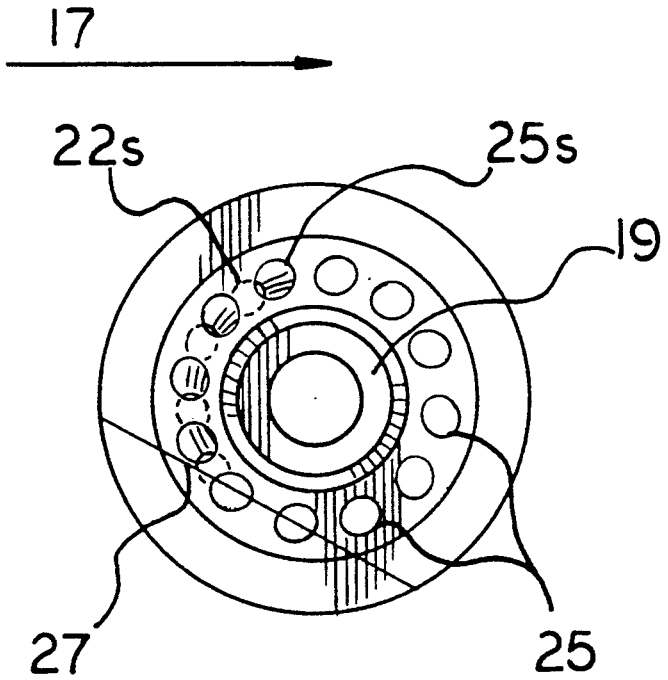
FIG. 1*b* is a back view of the left-handed wheel of the present invention.

FIGS. 1*a* and 1*b* show front and back faces of a wheel 10 of a roller skate of the invention. The wheels are usally composed of a polyurethane tire 12, having a peripheral surface 13, heat sealed to the rim of hubs 14, which are also usally made of a polyurethane composition.

Viewing the wheel 10 from its front and looking from the inside thereof and working backward, as shown in FIG. 1*a*, it is seen that hub 14 has a central circular opening 16, the center of which defines the axis of rotation of the hub. In front of central opening 16 and coaxial thereto is circular seat 18 having a diameter larger than the diameter of central opening 16. Central opening 16 receives an axle (not shown); seat 18 receives bearings (not shown) and an axle fastening member (not shown) such as a nut. From the end of circular seat 18 to any point axially positioned on the hub in front of seat 18 the opening expands radially outwardly and generally uniformly in the axial direction, such that the inside surface of the hub defines the boundaries of a truncated cone.

As shown in FIG. 1*a* positioned on the truncated surface of hub 14, radially inwardly from the peripheral surface of the wheel, are a plurality of elliptically-shaped openings 22. Openings 22 are spaced apart circumferentially on hub 14 about central opening 16. As shown, twelve openings are equally spaced apart by about thirty degrees. However, equal spacing and the number of openings is optional. Elliptically-shaped openings 22 are so aligned that a line 21 connecting the foci of one elliptically-shaped opening will intersect all other such lines, defined by the foci of each ellipse, at the axis of rotation of the wheel such that a plurality of radii are formed by such lines.

Openings 22 are the openings for paths or air passages 24 (more clearly shown in FIG. 3), which extend through hub 14 generally in the axial direction. Paths 24 are not linear such that straight paths are formed, but curvilinear as shown in FIG. 3 such that the a path 24 through the hub resembles a section of a circle i.e., a minor arc of such circle. When looking through path 24*s*, from the opening designated 22*s* (positioned at 12:00 o'clock on the wheel of FIG. 1*a*) of a stationary wheel, the path is shown to curve to the left and terminates at rear opening 25*s* of hub 14 as shown in FIG. 1*b*. A plane intersecting a path 24 perpendicular to the axis of rotation of the hub will show that the cross section of the path is circular. Relative to the direction of rotation of the wheel, which is indicated by arrow 17 in several of the drawing figures, opening 25*s* is positioned ahead of its counterpart opening 22*s* at 12:00 o'clock. The reverse is true after a half revolution of the wheel. This positioning, of course, is the result of the curvilinear path 24. The fact that openings 25, as shown in FIG. 1*b*, are elliptically shaped is also due to the fact that the paths 24 are curvilinear. As shown in FIG. 1*b*, line 27 connecting the foci of an opening 25 forms a chord relative to the circumference of hub 12. The elliptical shape of openings 22 is caused by the cone-shaped surface of the hub. The back face of the wheel of the invention, as shown in the FIG. 1*b*, includes the opposite end of central opening 16 and a second seat 19 similar to seat 18 for receiving bearings (not shown). The back face of the wheel, as shown, is relatively flat.

Hub 14 has an axial length of about 3.5 cm (1.37 inches) and a diameter of 4.5 cm (1.77 inches). The axial length of tire 12 is slightly greater than the axial length of hub 14 as shown in FIG. 1*a*. The diameter of paths 24 are generally equal and are approximately 0.476 cm (0.1875 inches). The openings 22 and 25, located radially inwardly from the periphery of the wheel, are located an equal distance (as measured from their centers) from the periphery. This distance is approximately 1.25 cm (0.492 inches). Preferably the radial distance of openings 25 on the back face of the hub (as measured from their centers to the peripheral surface of the hub) is less than the radial distance of openings 22. The wheel shown in FIGS. 1*a* and 1*b* having paths 24 curving to the left as described above are deemed left-handed wheels for reasons which will become clearer infra.

Figure 2A:
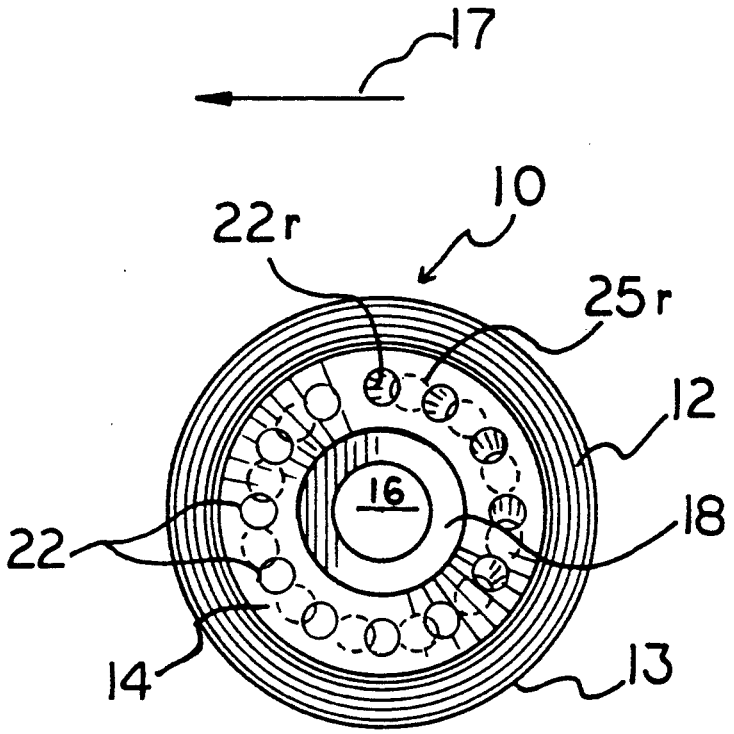
FIG. 2*a* is a front view of a right-handed wheel of the present invention.
Figure 2B:
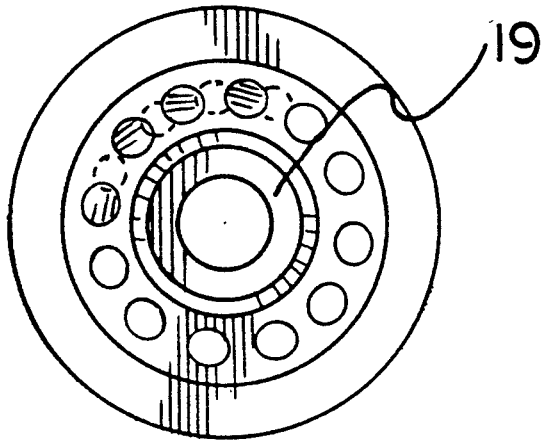
FIG. 2*b* is a back view of a right-handed wheel of the present invention.

Shown in FIGS. 2*a* and 2*b* are wheels which in all respects are similar to the wheels shown in FIGS. 1*a* and 1*b* except for the direction of the curve of paths 24. When looking through the path from the opening designated 22*r* (at 12 o'clock) of the stationary wheel of FIG. 2*a* the path is shown to curve to the right rather than to the left. Because of the direction that path 24 takes in the hub of FIGS. 2*a* and 2*b* opening 25*r*, relative to the direction of the rotation of the wheel, again designated by arrow 17, is positioned behind its counterpart opening 22*r*. The wheel shown in FIGS. 2*a* and 2*b* having paths 24 curving to the right as described above are deemed right-handed wheels for reasons which will become clearer infra.

Figure 4:
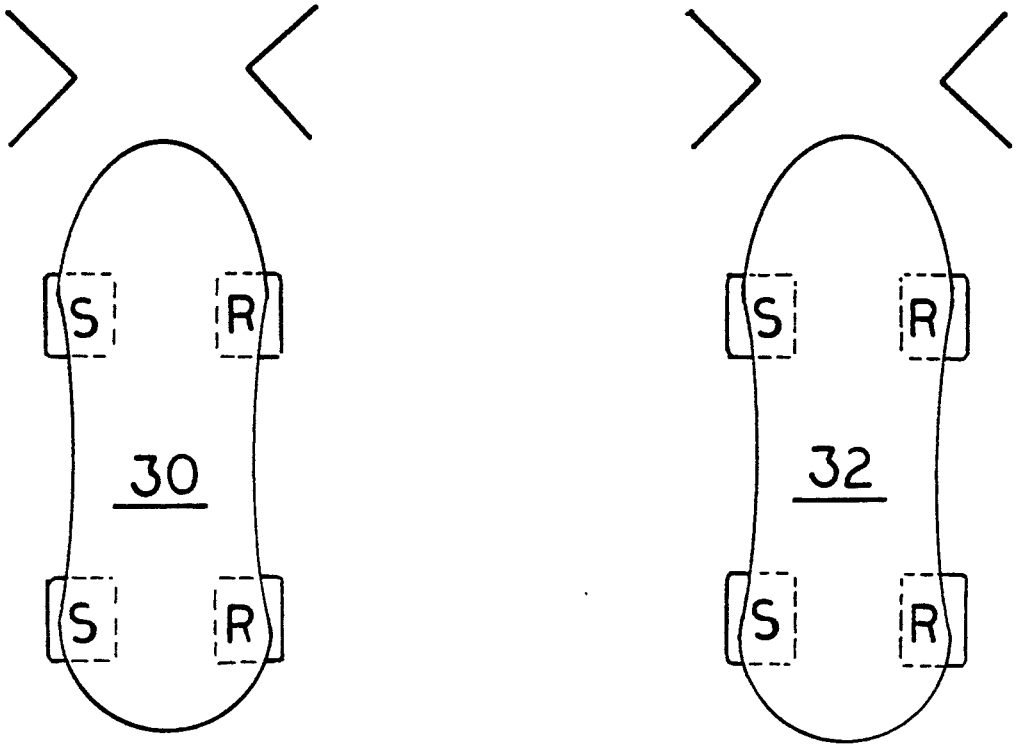
FIG. 4 is a schematic top view of a pair of skates on the left and right foot of a skater.

Shown in FIG. 4 is a schematic top view of a pair of skates, left skate 30 and right skate 32. Mounted to left-footed skate 30, on the left-hand side thereof, are front and rear left-handed wheels of FIG. 1*a* (designated with the letter "S"). The wheels are so mounted such that the front face of the wheel, i.e., the truncated cone-shaped face, is facing away from the skater. This is designated in the drawing by the > sign. The wheels are mounted such that the front face of hub 14, on the left hand side of the skate is exposed to the relative wind as the skater skates counter-clockwise around the skating rink and the flat side thereof is closet to the skate body. On the right side of skate 30 are mounted front and rear right-handed wheels (designated with the letter "R") such that the front face is on the outside of each wheel. The facing is designated by the < sign. The flat or rear face is mounted closet to the skate body.

Mounted to the left side of skate 32, as shown in FIG. 4 are front and rear left-handed wheels (designated as above) such that the front face thereof, as shown in FIG. 1*a* faces away from the skate body, again designated by the > sign. Mounted to the right-hand side of the front and rear of skate 32 are right-handed wheels shown in FIGS. 2 such that the face of the wheel shown FIG. 2*a* is facing outward away from the skater as designated by the < sign.

Figure 5:
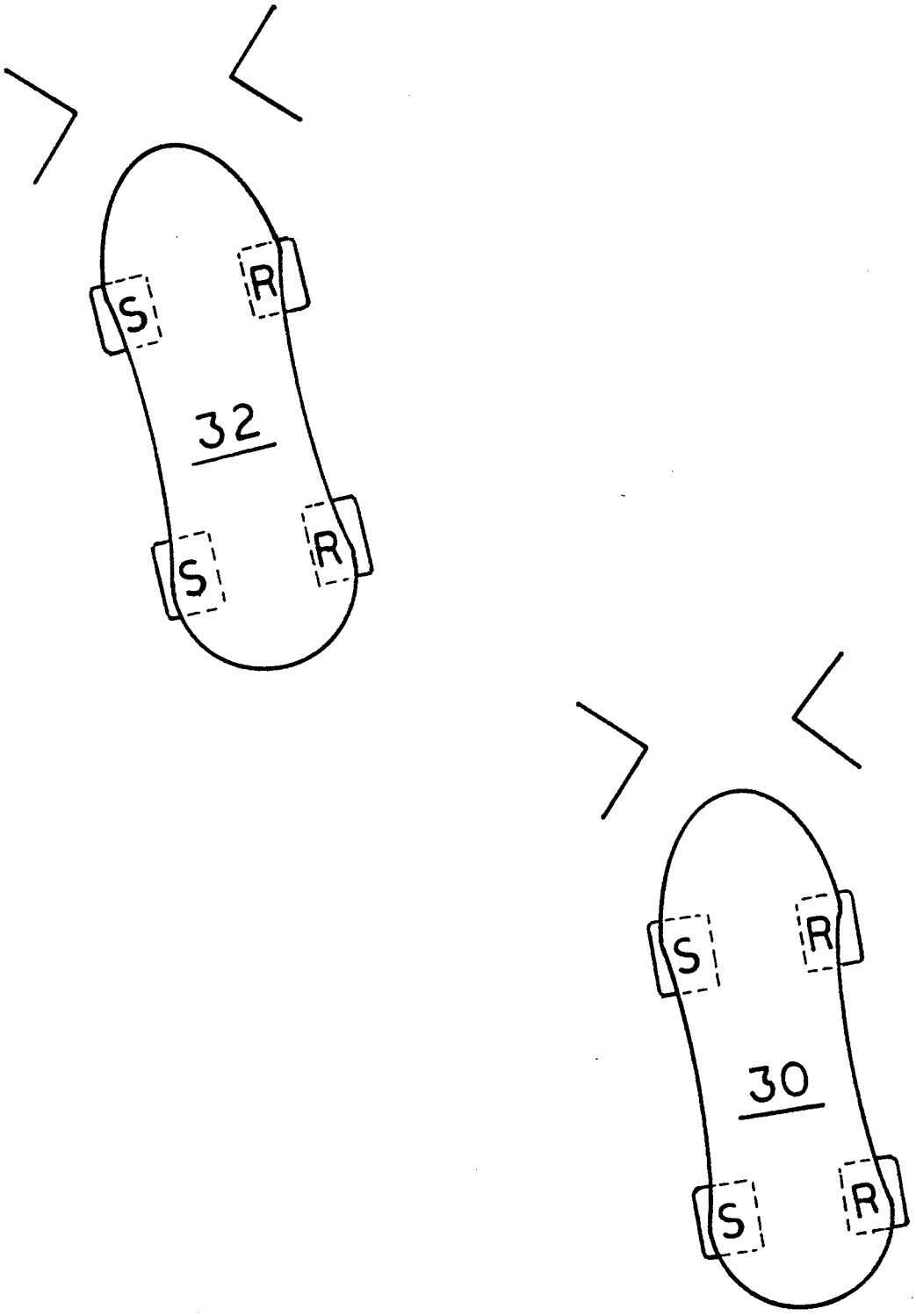
FIG. 5 is a schematic top view of a pair of skates on a skater making a left circular turn.

The wheels attached to the skates as indicated above, and used by a skater racing on a circular rink in the counterclockwise direction, will experience an increase in angular momentum (without the skater exerting any additional energy beyond that required for turning) when the skater crosses his right leg over the left to turn (see FIG. 5). That is, when the skater changes direction such that his skates are angled at least about twenty-eight degrees relative to the wind (flow of air past the skater), air enters the curvilinear paths 24 of the wheels. The curvilinear paths 24 change the direction of the air flow. In this manner, momentum is transferred from the moving air to the spinning wheels, thus increasing the number of revolutions of the wheel. The increase may be between 15 and 30%. Since the competitive rink is small the skater is actually turning for greater distances than the skater is skating on a straightaway. Accordingly, the increase in angular momentum imparted to the wheels is significant during the course of the race.

The wheels are currently produced in batch by pouring polyurethane compositions into respective right- and left-handed molds. A mold 40 similar to the mold for producing the wheel of FIG. 1 is shown in FIG. 6. Mold 40 includes twelve circumferentially arranged elongated and curved cylindrical fingers 42 which create paths or air passages 24 of wheels 12 during the molding process. Polyurethane liquid compositions are poured into the mold, and after reasonable cooling the wheel is pulled from the mold. The process of making such wheels may be fully automated as soon as a two part segmented mold is developed.

What is claimed is:

1. A wheel for a speed roller skate having an axis of rotation, a peripheral surface having an axial length and inwardly extending front and back radial surfaces, a plurality of curvilinear air passages extending generally in the axial direction through the wheel and defining openings on said front and back radial surfaces, said air passages being circumferentially spaced apart about the axis of rotation of the hub, the opening of an air passage on the front radial surface of the wheel is located forward of a corresponding opening of the air passage on the back radial surface of the wheel and a skater in executing a "cross-over" maneuver to turn exposes the air passages of the wheel to an air stream allowing air to pass through the air passages such that the path of the air is changed and momentum is transferred from the air stream to the wheel increasing the angular momentum of the wheel.

2. The wheel of claim 1 wherein at least one of the curvilinear paths has a circular cross section.

3. The wheel of claim 1 wherein at least one of the openings on said first and second radial surfaces is a closed plane curve.

4. The wheel of claim 1 wherein said paths are equally spaced apart.

5. The wheel of claim 4 wherein the front openings on the radial surface are located radially inwardly a distance D, as measured from the peripheral surface to the center of the openings.

6. The wheel of claim 4 wherein the openings on the front radial surface are located radially inwardly a distance D, as measured from the peripheral surface to the center of the openings, and the radially inward distance defined from the center of the openings on the back radial surface to the peripheral surface is less than the distance D.

7. The wheel of claim 1 wherein a plurality of the openings are elliptical.

8. The wheel of claim 1 wherein the curvilinear paths curve, as viewed from the front radial surface and at the bottom of a stationary wheel through the generally axial direction of the wheel, to the right.

9. The wheel of claim 1 wherein the opening of an air passage on the front radial surface of the wheel is located rearward of the opening of the air passage on the back radial surface relative to the direction of rotation of the wheel.

10. The wheel of claim 1 wherein the curvilinear paths curve, as viewed from the front radial surface and at the bottom of a stationary wheel through the generally axial direction, to the left.

11. The wheel of claim 1 wherein the front and back radial surfaces of the wheel include a central opening for receiving an axle, and a seat coaxial to the central opening, for receiving bearings.

12. In a speed roller skate having wheels with hubs, a wheel supporting platform and an upper connected to said platform, the improvement comprising wheels having an axis of rotation, a peripheral surface having an axial length and inwardly extending front and back radial surfaces, a plurality of curvilinear air passages extending generally in the axial direction through the wheel defining openings on said front and rear radial surfaces, and said passages being circumferentially spaced apart about the axis of rotation of the wheel hub, the opening of an air passage on the front radial surface of the wheel is located forward of a corresponding opening of the air passage on the back radial surface of the wheel and a skater in executing a "cross-over" maneuver to turn exposes the air passages of the wheel to an air stream allowing air to pass through the air passages such that the path of the air is changed and momentum is transferred from the air stream to the wheel increasing the angular momentum of the wheel.

* * * * *